US005585909A

United States Patent [19]

Behe et al.

[11] Patent Number: 5,585,909

[45] Date of Patent: Dec. 17, 1996

[54] FLAME SPRAYED CERAMIC END CAPS

[75] Inventors: Thomas J. Behe, Webster; Paul M. Fromm, Rochester; Edward C. Hanzlik, Fairport, all of N.Y.

[73] Assignee: Xerox Corporation, Stamford, Conn.

[21] Appl. No.: 509,407

[22] Filed: Jul. 31, 1995

[51] Int. Cl.[6] ..... G03G 15/20

[52] U.S. Cl. ..... 355/285; 219/216; 492/56

[58] Field of Search ..... 355/285, 290; 219/216, 469; 29/895.32, 895; 492/16, 46, 56, 57

[56] References Cited

U.S. PATENT DOCUMENTS

| | | | |
|---|---|---|---|
| 4,109,135 | 8/1978 | Minden et al. | 219/216 |
| 4,544,828 | 10/1985 | Shigenobu et al. | 219/216 |
| 4,813,372 | 3/1989 | Kogure et al. | 118/60 |
| 4,893,151 | 1/1990 | Yamazaki et al. | 355/245 |
| 5,043,768 | 8/1991 | Baruch | 355/284 |
| 5,191,381 | 3/1993 | Yuan | 355/285 |
| 5,200,786 | 4/1993 | Fromm et al. | 355/284 |
| 5,298,957 | 3/1994 | Haupt et al. | 355/285 |
| 5,420,392 | 5/1995 | Sakata | 219/216 |
| 5,436,430 | 7/1995 | Tsuji et al. | 219/216 |

*Primary Examiner*—Joan H. Pendegrass
*Assistant Examiner*—Quana Grainger

[57] ABSTRACT

A heating device, which can be used in the fixing unit of an image forming apparatus, such as an electrophotographic copying or printing machine, for fixing a toner image on a final substrate. The heating device which is in the form of a heated fuser roller is provided with bands or coatings of material which impede the transfer of heat from the fuser roller to bearing structure associated therewith. The bands or coatings are applied by plasma spraying a ceramic material on either the surface of a fuser roll core or on journals of end caps, depending upon the specific construction of the fuser roller.

13 Claims, 3 Drawing Sheets

FLAME SPRAYED CERAMIC END CAPS

BACKGROUND OF THE INVENTION

This invention relates to fusing toner images and more particularly to a device used for fusing toner images.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

After the electrostatic latent image is recorded on the photoconductive surface, it is developed by bringing a developer material into contact therewith to thereby form toner images on the photoconductive surface. The images are generally transferred to a support surface such as plain paper to which it may be permanently affixed by heating or by the application of pressure or a combination of both.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip.

Fuser rolls are typically made from a tube of high thermal conductivity metal with end hubs or caps pressed and pinned or brazed or spin welded to the ends of the roll. The primary function of the hub, in particular a journal portion thereof, is to allow the bearing to be attached to a reasonably small diameter. The secondary function is to reduce heat flow out of the end of the roll. This will keep the bearing temperature low thereby increasing the the life of the grease and the bearing, and it will promote a more uniform temperature along the length of the roll near the roll ends.

Glass reinforced polyamide hubs used for some rolls were found to be unacceptable due to a finite fatigue life and being very fragile. Also, this type of end cap does not lend itself to spin welding.

Stainless steel has been used because of its relatively low thermal conductivity but it is very expensive. It does have reasonable reclaim life but galls sooner than desired.

Aluminum has been used due to its low cost. Fuser core reclaim is not feasible with these hubs as they have exhibited galling when used as a journal. Also, aluminum end caps are very thermally conductive.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention. These patents disclose instances where the physical properties of ceramic materials are exploited for various purposes relating to development and fusing of electrostatic latent images.

U.S. Pat. No. 5,191,381 granted to Jie Yuan on Mar. 2, 1993 discloses a ceramic heat roller whose body is formed of a resistor material having a positive coefficient of resistance (PTC) capable of self-heating and self-regulating temperature.

U.S. Pat. No. 4,109,135 granted to Minden et al on Aug. 22, 1978 discloses a fuser roll assembly for fusing xerographic materials. The fuser assembly comprises end caps which, as stated in the specification thereof, are preferably constructed of a poor heat conductor, such as stainless steel or an appropriate plastic or ceramic, for example.

U.S. Pat. No. 5,298,957 granted to Haupt et al on Mar. 29, 1994 discloses a way of reducing wear on the ends of a fuser roll and the fuser bearings due to the thermal expansion of the user roll. To this end, a fuser roll collar is provided with plurality of protrusions on its outer surface such that they contact the inner surface of a bearing to minimize heat transfer between the fuser roll collar and the fuser bearing.

U.S. Pat. No. 4,544,828 discloses a heating device utilizing ceramic particles as a heat source and adapted for use as a fixing apparatus. This patent also discloses anti-abrasive sleeves disposed intermediate a bearing and a fuser roll shaft.

U.S. Pat. No. 4,893,151 discloses a single component image developing apparatus including a developing roller coated with a Chemical Vapor Deposition ceramic and an elastic blade coated with a ceramic.

U.S. Pat. No. 5,043,768 discloses a rotating release liquid applying device for a fuser including an outer porous ceramic material.

BRIEF SUMMARY OF THE INVENTION

According to the present invention, a heating device, which can be used in the fixing unit of an image forming apparatus, such as an electrophotographic copying or printing machine is provided. The heating device which is in the form of a heated fuser roller is provided with coatings or bands of heat insulating material interposed between the fuser roller and its associated bearing structure for the purpose of impeding the transfer of heat from the fuser roller structure to bearing. The bands or coatings are preferably applied to the fuser roll structure, for example, by plasma spraying a ceramic material on either a fuser roll surface or on end caps thereof, depending upon the specific construction of the fuser roller structure. The ceramic coatings or bands are plasma sprayed onto the relevant parts or areas of the fuser roll structure in the desired thickness and the sprayed ceramic material has the desired thermal conductivity properties. If necessary, the material forming the coatings or bands may be ground to the desired thickness using techniques in the art well-known.

In the embodiment where the coatings or bands are applied to the roller's end caps, the end caps including a journal portion thereof are fabricated from a material such that the end cap can be readily spin welded to the fuser sleeve or core. For example, the end caps and journal portion thereof are fabricated from stainless steel. The most expensive materials are carbon steel and aluminum.

Machining of the bearing surfaces of the coatings or bands can be controlled to a tight tolerance and the ceramic coating is very hard. thereby eliminating any potential for galling in the areas of contact. Additionally, reclaim of the core is facilitated even with end cap materials that would not otherwise be reclaimable.

DETAILED DESCRIPTION OF THE PREFERRED EMBODIMENT OF THE INVENTION

Figure 4:
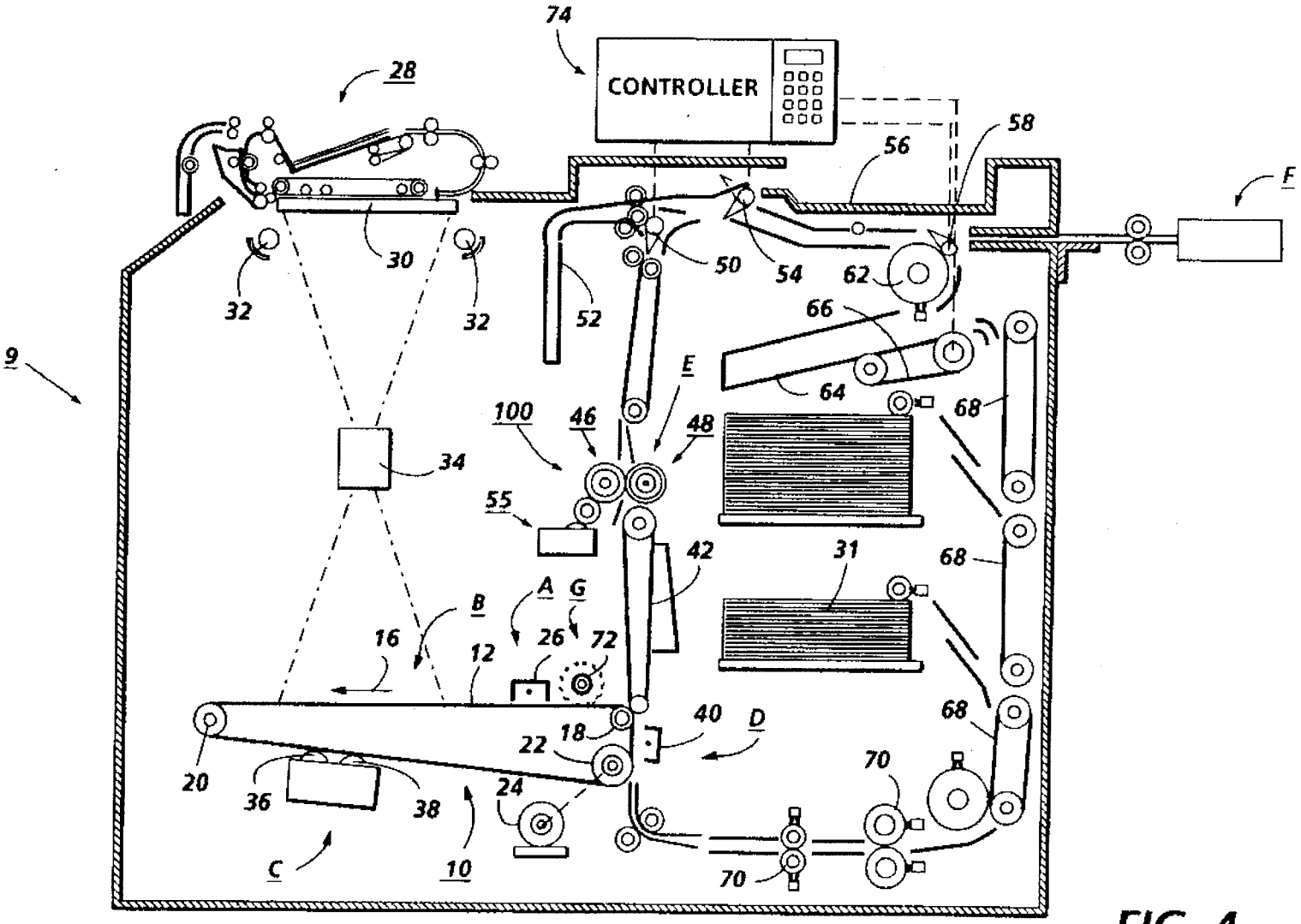
FIG. 4 is a schematic illustration of a printing apparatus in which the inventive features of the invention may be employed.

For a general understanding of the features of the present invention, reference is made to the drawings. In the drawings, like reference numerals have been used throughout to identify identical elements. FIG. 4 schematically depicts an electrophotographic printing machine 9 incorporating the features of the present invention therein.

Referring to FIG. 4 of the drawings, the electrophotographic printing machine employs a belt 10 having a photoconductive surface 12 deposited on a conductive substrate, not shown. Belt 10 moves in the direction of arrow 16 to advance successive portions of photoconductive surface sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive belt passes through a charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through an imaging station B. At imaging station B, a document handling unit, indicated generally by the reference numeral 28, is positioned over platen 30 of the printing machine. Document handling unit 28 sequentially feeds documents from a stack of documents placed by the operator faceup in a normal forward collated order in a document stacking and holding tray. A document feeder located below the tray forwards the bottom document in the stack to a pair of take-away rollers. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair.

Imaging of a document is achieved using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document.

Obviously, electronic imaging of page image information could be facilitated by a printing apparatus utilizing electrical imaging signals. The printing apparatus can be a digital copier including an input device such as a Raster Input Scanner (RIS) and a printer output device such as a Raster Output Scanner (ROS), or, a printer utilizing only a printer output device such as a ROS.

Thereafter, belt 10 advances the electrostatic latent image recorded on photoconductive surface 12 to development station C. At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

Prior to reaching transfer station D, a copy sheet 31 is placed in proper lateral edge alignment. At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 100, which permanently affixes the transferred toner powder image to the copy sheet. Fuser assembly 100 includes a heated fuser roller 46 and a back-up roller 48 with the powder image on the copy sheet contacting fuser roller 46. The pressure roller is cammed against the fuser roller to provide the necessary pressure to fix the toner powder image to the copy sheet. The fuser roll is internally heated by a quartz lamp.

After fusing, the copy sheets are fed to gate 50 which functions, as an inverter selector. Depending upon the position of gate 50, the copy sheets are deflected to sheet inverter 52 or bypass inverter 52 and are fed directly to a second decision gate 54. At gate 54, the sheet is in a faceup orientation with the image side, which has been fused, faceup. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roll 62, or onto a transport path to finishing station F. At finishing station F, copy sheets are stacked in a compiler tray and attached to one another to form sets. The sheets are attached to one another by either a binding device or a stapling device. In either case, a plurality of sets of documents are formed in finishing station F. When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. The paper path signature analysis apparatus of the present invention can be utilized to keep track of the position of the documents and the copy sheets. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station F.

Figure 1:
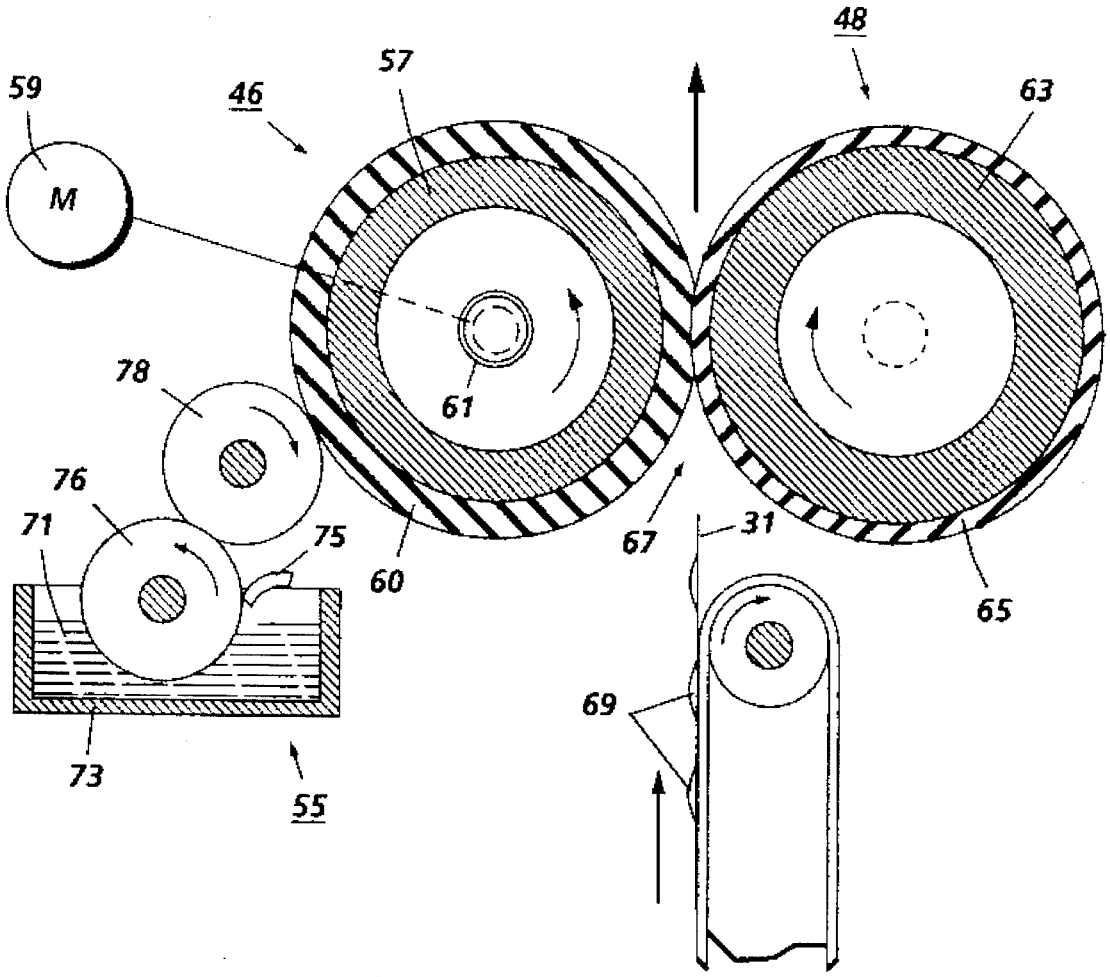
FIG. 1 PRIOR ART
FIG. 1 discloses a prior art heat and pressure fuser and release agent management system therefor.

Attention is now directed to FIG. 1 wherein the heat and pressure fuser apparatus comprising the fuser roller 46 and pressure roller 48 are illustrated together with a release agent management (RAM) system 55. As shown in FIG. 1, the fuser apparatus comprises the heated fuser roller 46 which comprises a core or body portion 57 having coated thereon a layer 60 of deformable elastomeric material such as silicone rubber or a non-deformable, low surface energy coating like Teflon™. Aluminum is preferred as the material for the core or body portion 57, although this is not critical. The core or body portion 57 is hollow and a heating element 61 is positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention. Thus, the fuser member can be heated by internal means, external means or a combination of both. Heating means are well known in the art for providing sufficient heat to fuse the toner to the support. The fusing surface layer may be fabricated using any well known material such as RTV and HTV silicone rubbers as well as Viton (trademark of E.I. dupont de Nemours & Co.) or Teflon™. A motor 59 serves to effect rotation of the fuser roll structure 46 for effecting movement of a copy sheet between the fuser roll and pressure.

The fuser roller 46 is shown in a pressure contact arrangement with the backup or pressure roller 48. The pressure roller 48 comprises a metal core 63 with a layer 65 of a heat-resistant material. In this assembly, both the fuser roller 46 and the pressure roller 48 are mounted on bearings (not shown) which are biased so that the fuser roller 46 and pressure roller 48 are pressed against each other under sufficient pressure to form a nip 67. It is in this nip that the fusing or fixing action takes place. The layer 65 may be fabricated from any well known deformable material such as fluorinated ethylene propylene copolymer or silicone rubber. The thickness of the layer 65 is less than the thickness of the layer 60 of the fuser roller in the case of a Nip Forming Fuser Roll (NFFR) and greater in the case of a Nip Forming Pressure Roll (NFPR).

The image receiving member or final support 31 having toner images 69 thereon is moved through the nip 67 with the toner images contacting the heated fuser roller 46. The toner material forming the image 69 is prevented from offsetting to the surface of the fuser roller 46 by the application of a release agent material such as silicone oil 71 contained in sump 73.

The sump 73 and silicone oil 71 form part of the RAM system 55. The RAM system 55 comprises a metering roller 76 and a donor roll 78. The metering roller is supported partially immersed in the silicone oil 71 and contacts the donor roll for conveying silicone oil from the sump to the surface of the donor roll 78. The donor roll is rotatably supported in contact with the metering roller 76 and also in contact with the fuser roller 46. While the donor roll is illustrated as contacting the fuser roller, it will be appreciated that, alternately, it may contact the pressure roller 48. Also, the positions of the fuser and pressure rollers may be reversed for use in other copiers or printers. A metering blade 75 serves to meter silicone oil to the required thickness on the metering roller. For further details of the RAM system 55 reference may be had to U.S. Pat. No. 5,200,786 granted to Fromm et al on Apr. 6, 1993.

It is believed that the foregoing description is sufficient for purposes of the present application to illustrate the general operation of an electrophotographic printing machine. Referring now to the specific subject matter of the present invention, FIGS. 2 and 3 depict features of two embodiments of the present invention.

Figure 2:
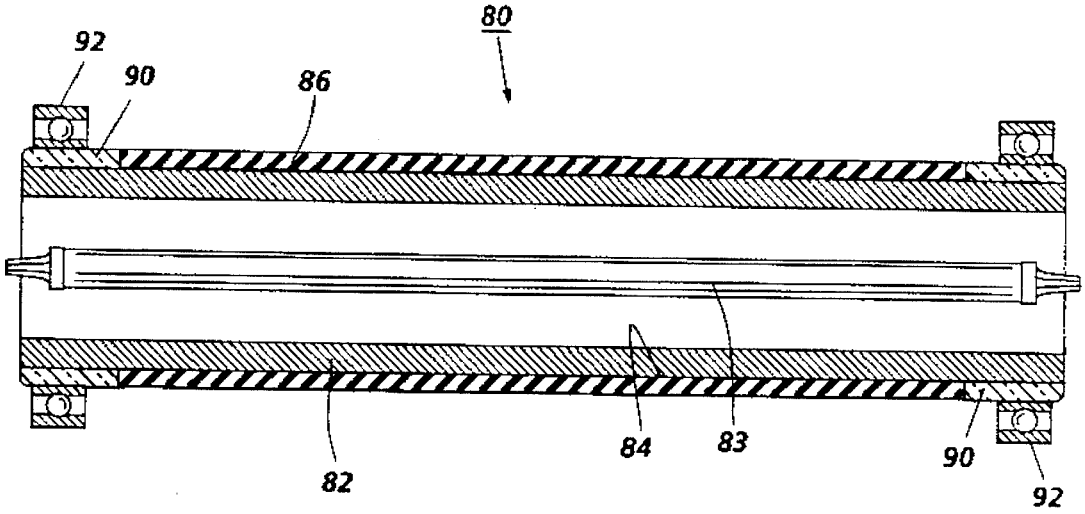
FIG. 2 illustrates a fuser roller, partially in cross-section, incorporating the present invention.

As shown in FIG. 2, a hubless fuser roll structure 80 comprises a core or body portion 82. The core has an outer surface 84 to which is adhered a layer of abhesive material 86 to which a release agent material is applied in a manner similar to that disclosed in connection description of FIG. 1. The core 82 is preferably fabricated from aluminum or stainless in the case of an instant-on, limited paper width fuser. The layer 86 may comprise a suitable elastomeric material such as as RTV and HTV silicone rubbers as well as Viton (trademark of E.I. dupont de Nemours & Co.) or low surface energy coatings like Teflon™.

A pair of coatings or bands 90 is applied to the surface 84 adjacent the ends thereof. The coating or band is preferably effected by flame spraying a heat insulative ceramic material with subsequent machining of the coating or band in accordance with well known techniques. The coatings or bands serve as heat barriers between the core and the inner surface of a bearing structure 92. The thickness of the coatings or bands 90 is in the order of 1 to 3 mm. The coating may be applied in a thickness greater than 3 mm and then machined to the desired thickness.

Figure 3:
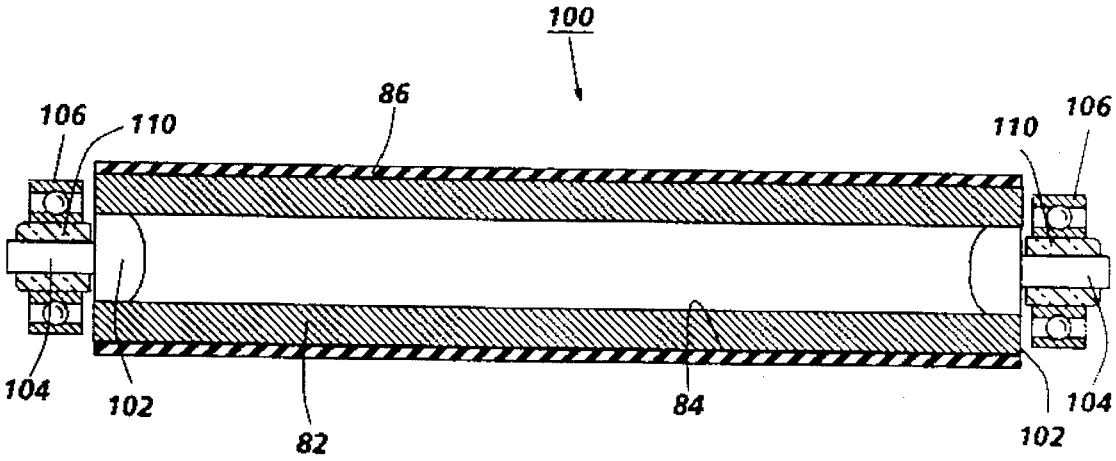
FIG. 3 depicts a fuser roller, partially in cross-section, incorporating a modified form of the invention.

A modified embodiment of the invention, as illustrated in FIG. 3, comprises a fuser roll structure 100 including a core or sleeve 82. The core has an outer surface 84 to which is adhered a layer of abhesive material 86 to which a release agent material is applied in a manner similar to that disclosed in connection description of FIG. 1. The core 82 is preferably fabricated from aluminum. The layer 86 may comprise a suitable elastomeric material such as as RTV and HTV silicone rubbers as well as Viton (trademark of E.I. dupont de Nemours & Co.) or low surface energy coatings like Teflon™.

The fuser roll structure 100 comprises end caps 102 which are spin welded or other wise suitably attached to the core or body portion 82 at opposite ends thereof. To this end, the end caps are fabricated from a material, for example stainless steel, carbon steel of aluminum suitable for spin welding thereof to the fuser core 82. The end caps include journals 104 and bearings 106 carried thereby for supporting the fuser roll structure in a machine frame, not shown. A coating or band 110 of ceramic material is applied to each of the journals using a well known flame spray technique. The coatings or bands are very hard and may be machined to a tight tolerance in order to prevent galling of the bearing surface contacted thereby.

What is claimed is:

1. A fuser structure for fixing toner images to an image receiving surface, said structure comprising:

a core structure;

end caps including journal portions attached to said core structure;

an abhesive layer secured to said core structure;

a plurality of bearings for operatively supporting said fuser structure in an imaging device; and heat barrier coatings carried by said journal portions, said heat barrier coatings being interposed between said journal portions and said bearings.

2. Apparatus according to claim 1 wherein said coatings comprise heat insulative ceramic material.

3. Apparatus according to claim 2 wherein said coatings are flame sprayed onto said journals.

4. Apparatus according to claim 3 wherein the thickness of said coatings is in the order of 1 to 3 mm.

5. Apparatus according to claim 4 wherein said end caps are fabricated from material readily spin welded to said body portion.

6. A method of constructing a fuser structure for fixing toner images to an image receiving surface, said method including the steps of:

providing a core structure;

attaching end caps including journal portions to said core structure;

applying an abhesive layer to said core structure;

providing a plurality of bearings for supporting said fuser structure in an imaging device; and applying heat barrier coatings to said journal portions, said heat barrier coatings being interposed between said journal portions and said bearings.

7. The method according to claim 6 wherein said coatings comprise heat insulative ceramic material.

8. The method according to claim 7 wherein said coatings are flame sprayed onto said journals.

9. The method according to claim 8 wherein said step of flame spraying comprises spraying material to a thickness greater that 3 mm; and further comprising the step of machining said coatings to a desired thickness.

10. The method according to claim 8 wherein the thickness of said coatings is in the order of 1 to 3 mm.

11. The method according to claim 10 wherein said end caps are fabricated from material readily spin welded to said body portion.

12. The method according to claim 6 wherein said coatings are flame sprayed onto said journals.

13. The method according to claim 12 wherein the thickness of said coatings is in the order of 1 to 3 mm.

* * * * *